US010214331B2

(12) United States Patent
Lee

(10) Patent No.: US 10,214,331 B2
(45) Date of Patent: Feb. 26, 2019

(54) COSMETIC CONTAINER HAVING AIR CIRCULATION SURFACE

(71) Applicant: PUM-TECH KOREA CO., LTD, Incheon (KR)

(72) Inventor: Do Hoon Lee, Incheon (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 0 days.

(21) Appl. No.: 15/641,577

(22) Filed: Jul. 5, 2017

(65) Prior Publication Data

US 2018/0370696 A1 Dec. 27, 2018

(30) Foreign Application Priority Data

Jun. 27, 2017 (KR) ..... 10-2017-0081053

(51) Int. Cl.
*B65D 47/32* (2006.01)
*B65D 43/16* (2006.01)
(Continued)

(52) U.S. Cl.
CPC ..... *B65D 47/32* (2013.01); *A45D 34/00* (2013.01); *A45D 40/22* (2013.01); *B65D 43/163* (2013.01);
(Continued)

(58) Field of Classification Search
CPC ..... B65D 47/32; B65D 43/165; B65D 53/00; B65D 43/163; B65D 51/18;
(Continued)

(56) References Cited

U.S. PATENT DOCUMENTS 3,441,033 A * 4/1969 Flax ..... A45D 33/20 132/295
4,589,430 A * 5/1986 Sussman ..... A45D 40/22 132/218
(Continued)

FOREIGN PATENT DOCUMENTS

JP 4068397 B2 2/2003
KR 20-0316056 Y1 6/2003
(Continued)

*Primary Examiner* — Kareen K Thomas
(74) *Attorney, Agent, or Firm* — Heedong Chae; Lucem, PC

(57) ABSTRACT

Disclosed is a cosmetic container having an air circulation surface, which includes an inner container for containing a content therein and an inner container lid provided with a sealing protrusion wheel for sealing the inner container. The cosmetic container includes a first sealing protrusion formed on the inner container; a second sealing protrusion formed on the sealing protrusion wheel of the inner container lid; and the air circulation surface including a fine protrusion and a groove provided on the first sealing protrusion of the inner container or the second sealing protrusion of the inner container lid, wherein air compressed in the inner container is discharged while being uniformly distributed over the entire air circulation surface when the inner container lid is closed, and outside air is introduced into the inner container through the entire air circulation surface when the inner container lid is opened.

6 Claims, 9 Drawing Sheets

(51) Int. Cl.
*B65D 53/00* (2006.01)
*B65D 51/18* (2006.01)
*A45D 40/22* (2006.01)
*A45D 34/00* (2006.01)

(52) U.S. Cl.
CPC ..... *B65D 43/165* (2013.01); *B65D 51/18* (2013.01); *B65D 53/00* (2013.01); *B65D 2251/009* (2013.01); *B65D 2251/0021* (2013.01); *B65D 2251/0028* (2013.01); *B65D 2251/0084* (2013.01)

(58) Field of Classification Search
CPC .... B65D 2251/0084; B65D 2251/0028; B65D 2251/009; B65D 2251/0021; A45D 40/22; A45D 34/00
USPC ..... 220/259.2, 256.1, 259.1, 810, 826, 244, 220/845, 847, 848, 843, 23.86, 2, 3.87
See application file for complete search history.

(56) References Cited

U.S. PATENT DOCUMENTS 4,807,773 A * 2/1989 Tsai ..... A45D 33/24 132/296
4,815,483 A * 3/1989 DuGrenier ..... A45D 33/00 132/295
D344,817 S * 3/1994 Chen ..... D28/82
5,337,890 A * 8/1994 Lai ..... A45C 11/008 132/296
5,975,093 A * 11/1999 Joulia ..... A45C 13/008 132/293
6,189,698 B1 * 2/2001 Asser ..... A45C 11/008 132/314
D471,321 S * 3/2003 Lai ..... D28/82
6,540,083 B2 * 4/2003 Shih ..... A45D 40/24 132/294
6,988,630 B2 * 1/2006 Matsumoto ..... A45D 33/006 132/295
D517,737 S * 3/2006 Lai ..... D28/82
7,047,983 B2 * 5/2006 Manougian ..... A45D 33/006 132/294
D524,989 S * 7/2006 Lombardi ..... D28/82
7,311,416 B1 * 12/2007 Kudma ..... A45D 33/22 132/293

FOREIGN PATENT DOCUMENTS

KR 20-2005-0004184 Y1 5/2005
KR 10-2012-0120337 B1 3/2014
KR 10-1378521 B1 3/2014
KR 10-2015-0043937 A 10/2016

* cited by examiner

COSMETIC CONTAINER HAVING AIR CIRCULATION SURFACE

CROSS-REFERENCE TO RELATED APPLICATION

This application claims the benefit of Korean application No. 10-2017-0081053 filed on Jun. 27, 2017, with the Korean Intellectual Property Office, the disclosure of which is incorporated herein by reference.

BACKGROUND

The present invention relates to a cosmetic container having an air circulation surface and, more specifically, to a cosmetic container having an air circulation surface which includes an inner container for containing contents therein and an inner container lid provided with a sealing protrusion wheel for sealing the inner container, where a first sealing protrusion protrudes inwardly from the inner container, a second sealing protrusion protrudes outwardly from the sealing protrusion wheel of the inner container lid, the air circulation surface including a plurality of fine protrusions and grooves is formed an the first sealing protrusion as the first sealing protrusion is sanded, and, when the inner container lid is opened or closed, the second sealing protrusion of the inner container lid goes over the first sealing protrusion while making contact with the air circulation surface of the inner container, so that the opening/closing sensitivity of the inner container lid is improved and the inner container lid is prevented from being lifted up while air is compressed in the inner container.

As modern society continues to evolve, it has been various and diversified. In this social change, regardless of sex or age, appropriate cosmetics have been used according to the personality, taste and purpose of a person.

Specifically, such cosmetics not only keep skin healthy and clean, but also help to better represent and personalize the individuality of a user by giving color to cosmetics. Thus, many kinds of color cosmetics have been widely used.

Such color cosmetics are used to make a face more beautiful after basic makeup. There are various kinds of cosmetics to apply makeup suitable according to a face area. The color cosmetics having a color selected to be suitable for the skin color of a user or the design and color of clothes to be worn is used.

Such color cosmetics are used while being mainly contained in a compact container. An impregnation member or gel-type color cosmetic contents is or are kept in the compact container. To use the cosmetics, after an outer lid is opened from a container main body, the cosmetic contents are stuck on a makeup tool such as a puff or a brush to make up a face.

Since the foundation among color cosmetics contains a large amount of volatile solvent and moisture, when the sealing force of the inner container containing the color cosmetics is lowered, the volatile solvent, and moisture are evaporated into the air, so that the foundation is hardened to lose the typical function thereof. Thus, there is a need to provide a method capable of preventing the volatile solvent and moisture of the foundation from being evaporated.

Thus, to prevent the evaporation of moisture and the volatilization of a volatile component contained in the foundation, the airtightness of the compact container is secured by further coupling an inner container lid for opening or closing the inner container. However, when the inner container lid is closed to close the inner container, the air in the inner container is compressed so that the inner container lid does not fully adhere to the inner container to be lifted, thereby deteriorating the sealing strength of the inner container.

To solve the above problems, there has been disclosed a cosmetic case having an air discharge structure for a refill container in Korean Registered Utility Model No. 20-0316056.

As shown in FIG. 1, the conventional cosmetic case includes a second cover for opening or closing the refill container in which a receiving hole having a first air vent hole is formed, and a valve body for discharging the air compressed in the receiving hole to an outside. The valve is formed with a tension plate, a protrusion film and a second air vent hole such that the closing operation of the second cover for sealing the refill container is smoothly performed.

However, according to the related art, since the valve body having the tension plate, the protrusion film and the second air vent hole must be installed to the second cover, the structure of the cosmetic case is complicated, the assembling process is increased, so that the productivity is lowered, thereby increasing the production cost.

To solve the above problems, there has been disclosed an airtight cosmetic container in Korean Registered Patent No. 10-1378521.

As shown in FIG. 2, the conventional airtight cosmetic container includes a container main body, an inner container coupled to the inside of the container main body, and an inner cover having a sealing rib that seals the inner container. In addition, the inner container includes a cosmetic container and a packing case, where an air vent groove is formed in an inner peripheral surface of an outer elastic piece of the packing case so that air compressed in the cosmetic container is discharged through the air vent groove when the cosmetic container is closed.

However, according to the related art, when an inner lid is opened and closed, the sealing lid of the inner lid is in surface contact with the inner and outer curved protrusions of the packing case, and is strongly pushed and inserted into an inside or an outside, so that the opening/closing sensitivity of the inner lid is deteriorated.

In addition, according to the related art described above, an air vent groove is partially formed in the outer curved protrusion formed in the outer elastic piece of the packing case, so that air flows in or out while being concentrated in the air vent groove of the packing case when the inner cover is opened or closed. As the result, the volatile components and moisture contained in the cosmetics in the cosmetic container are discharged through the air vent grooves, so that a serious defect is caused in the sealing of the cosmetic container.

SUMMARY

To solve the problems described above, an object of the present invention is to provide to a cosmetic container having an air circulation surface which includes an inner container for containing contents therein and an inner container lid provided with a sealing protrusion wheel for sealing the inner container, where a first sealing protrusion protrudes inwardly from the inner container, a second sealing protrusion protrudes outwardly from the sealing protrusion wheel of the inner container lid, the air circulation surface including a plurality of fine protrusions and grooves is formed on the first sealing protrusion as the first sealing protrusion is sanded, and, when the inner container lid is opened or closed, the second sealing protrusion of the inner container lid goes over the first sealing protrusion while making contact with the air circulation surface of the inner container, so that the opening/closing sensitivity of the inner container lid is improved and the inner container lid is prevented from being lifted up while air is compressed in the inner container.

Another object of the present invention is to provide a cosmetic container having an air circulation surface in which a first sealing protrusion wheel is formed on an inner periphery of an upper portion of an outer wall of an inner container and an air circulation surface is formed on the entire upper surface of the first sealing protrusion wheel, such that the air compressed in the inner container is discharged while being uniformly distributed over the entire air circulation surface when an inner container lid is closed and outside air is introduced through the entire air circulation surface when the inner container lid is opened, thereby enabling the inner container lid to be smoothly opened or closed. In addition, the inner container lid is prevented from being lifted up while the air is compressed in the inner container, so that the sealing strength is improved.

According to an aspect of the present invention, there is provided a cosmetic container having an air circulation surface, which includes an inner container for containing a content therein and an inner container lid provided with a sealing protrusion wheel for sealing the inner container, the cosmetic container including:

a first sealing protrusion formed on the inner container;

a second sealing protrusion formed on the sealing protrusion wheel of the inner container lid; and the air circulation surface including a fine protrusion and a groove provided on the first sealing protrusion of the inner container or the second sealing protrusion of the inner container lid, wherein air compressed in the inner container is discharged while being uniformly distributed over the entire air circulation surface when the inner container lid is closed, and outside air is introduced into the inner container through the entire air circulation surface when the inner container lid is opened.

The inner container is formed with an inner wall and an outer wall, the first sealing protrusion is formed on an inner periphery of an upper portion of the outer wall, and the air circulation surface is formed over an entire surface of an upper inner portion of the first sealing protrusion.

The first sealing protrusion of the inner container is formed on an inner periphery of an upper portion thereof with a first oblique surface on which the air circulation surface is formed.

The second sealing protrusion of the inner container lid is formed on an inner periphery of a lower portion thereof with a second oblique surface on which the air circulation surface is formed.

The second sealing protrusion of the inner container lid goes over the first sealing protrusion while making point-contact with the air circulation surface formed on the inner container when the inner container lid is opened or closed.

The air circulation surface is injection-molded through a mold having a molding space, a part of which is corroded by chemical, or injection-molded through a mold having a molding space, a part of which is sanded.

According to the present invention, the cosmetic container having an air circulation surface includes the inner container for containing contents therein and the inner container lid provided with a sealing protrusion wheel for sealing the inner container, where the first sealing protrusion protrudes inwardly from the inner container, the second sealing protrusion protrudes outwardly from the sealing protrusion wheel of the inner container lid, the air circulation surface including a plurality of fine protrusions and grooves is formed on the first sealing protrusion as the first sealing protrusion is sanded, and, when the inner container lid is opened or closed, the second sealing protrusion of the inner container lid goes over the first sealing protrusion while making contact with the air circulation surface of the inner container, so that the opening/closing sensitivity of the inner container lid is improved and the inner container lid is prevented from being lifted up while air is compressed in the inner container.

In addition, according to the cosmetic container having an air circulation surface of the present invention, the first sealing protrusion wheel is formed on the inner periphery of the upper portion of the outer wall of the inner container and the air circulation surface is formed over the entire upper surface of the first sealing protrusion wheel, such that the air compressed in the inner container is discharged while being uniformly distributed into the entire air circulation surface when the inner container lid is closed and outside air is introduced through the entire air circulation surface when the inner container lid is opened, thereby enabling the inner container lid to be smoothly opened or closed. In addition, the inner container lid is prevented from being lifted up while the air is compressed in the inner container, so that the sealing strength is improved.

DETAILED DESCRIPTION OF THE EMBODIMENTS

The technical objects described above of the present invention will become more apparent from the following descripted preferable embodiments. Hereinafter, a cosmetic container having an air circulation surface according to an embodiment of the present invention will be described in detail with reference to accompanying drawings.

Figure 1:
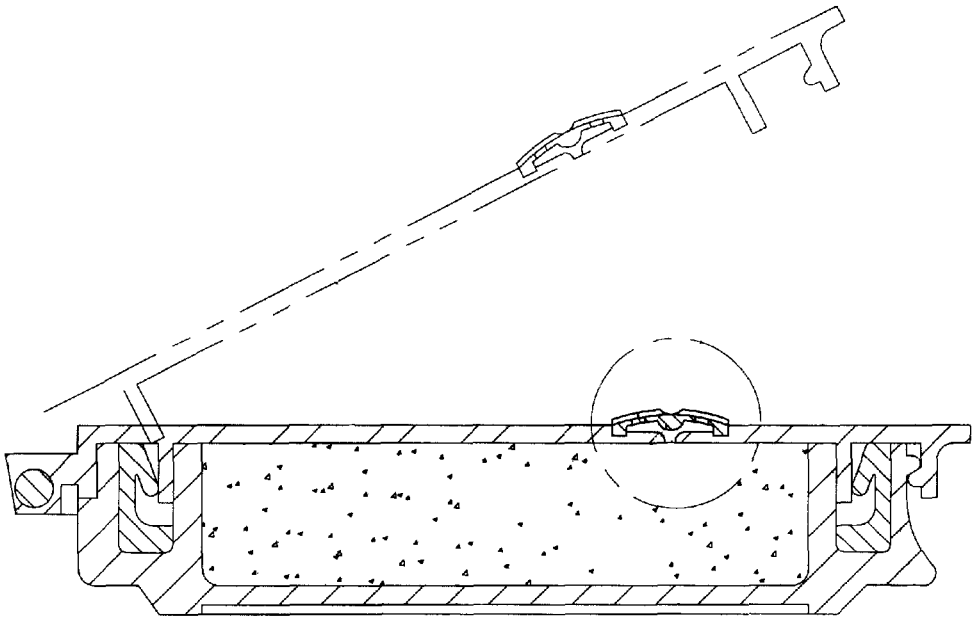
FIG. 1 is a view illustrating a cosmetic case having an air discharge structure for a refill container according to the related art.
Figure 2:
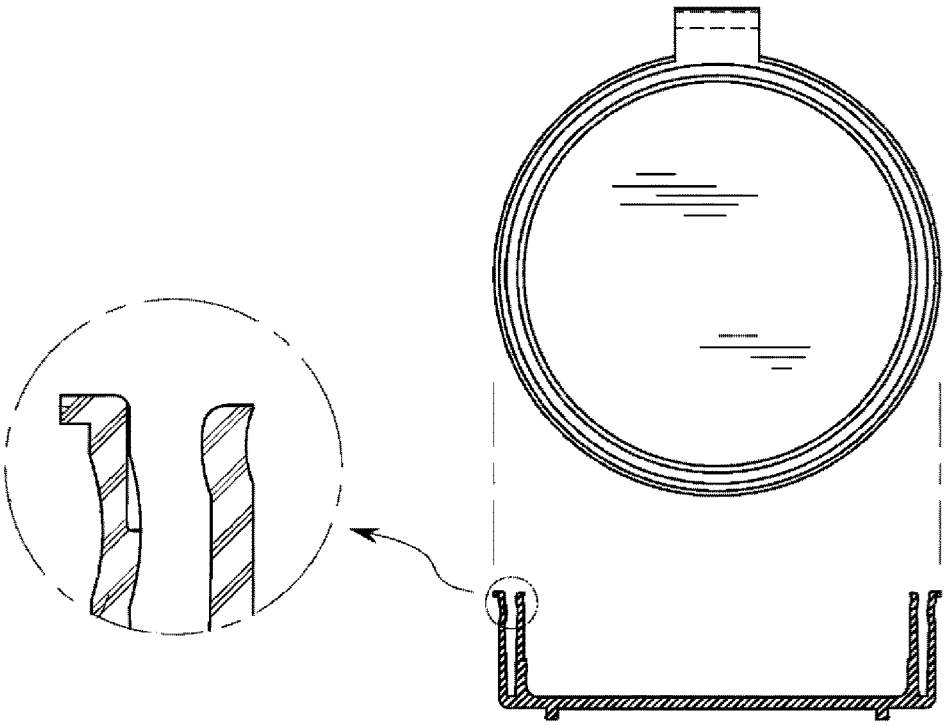
FIG. 2 is a view illustrating an airtight cosmetic container according to the related art.
Figure 3:
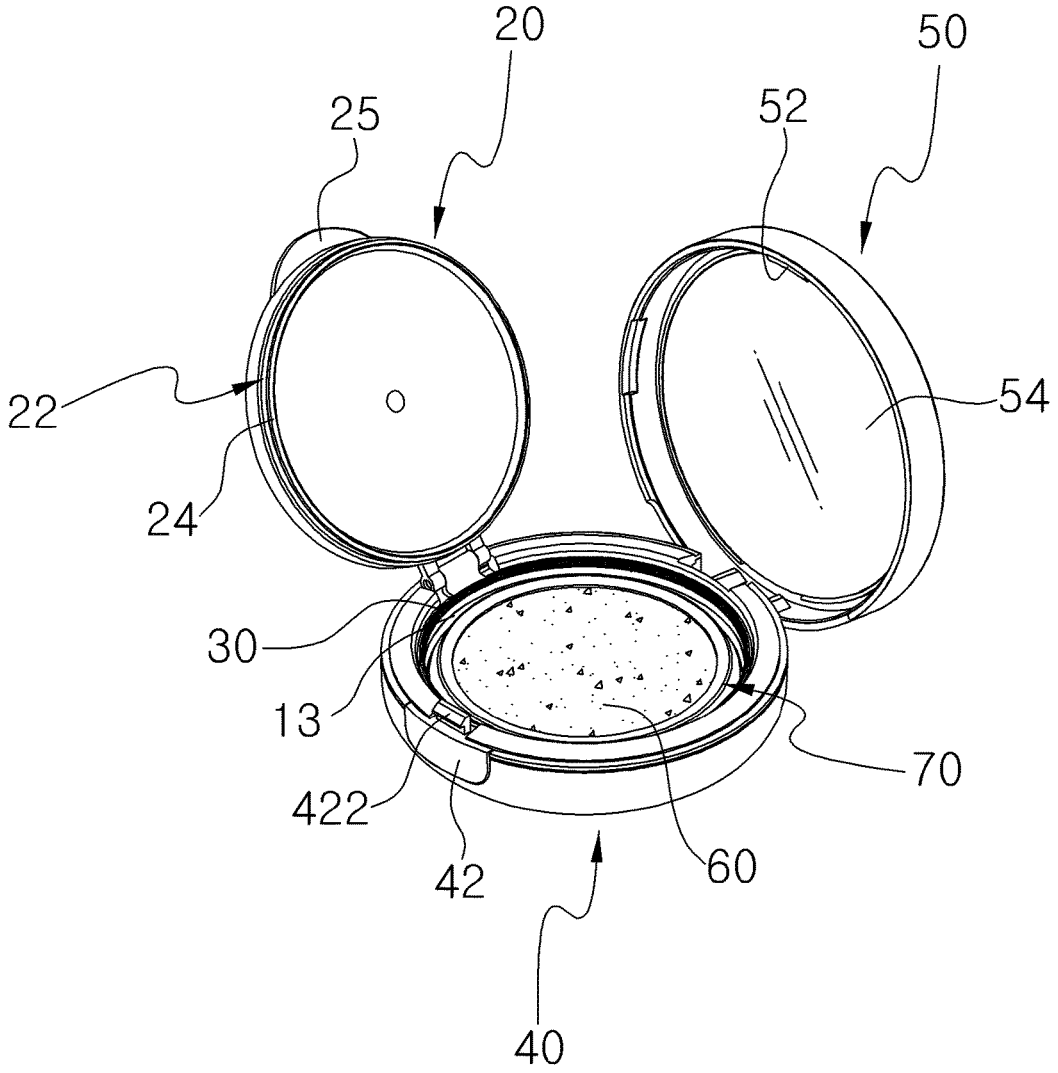
FIG. 3 is a perspective view illustrating a cosmetic container according to an embodiment of the present invention.
Figure 4:
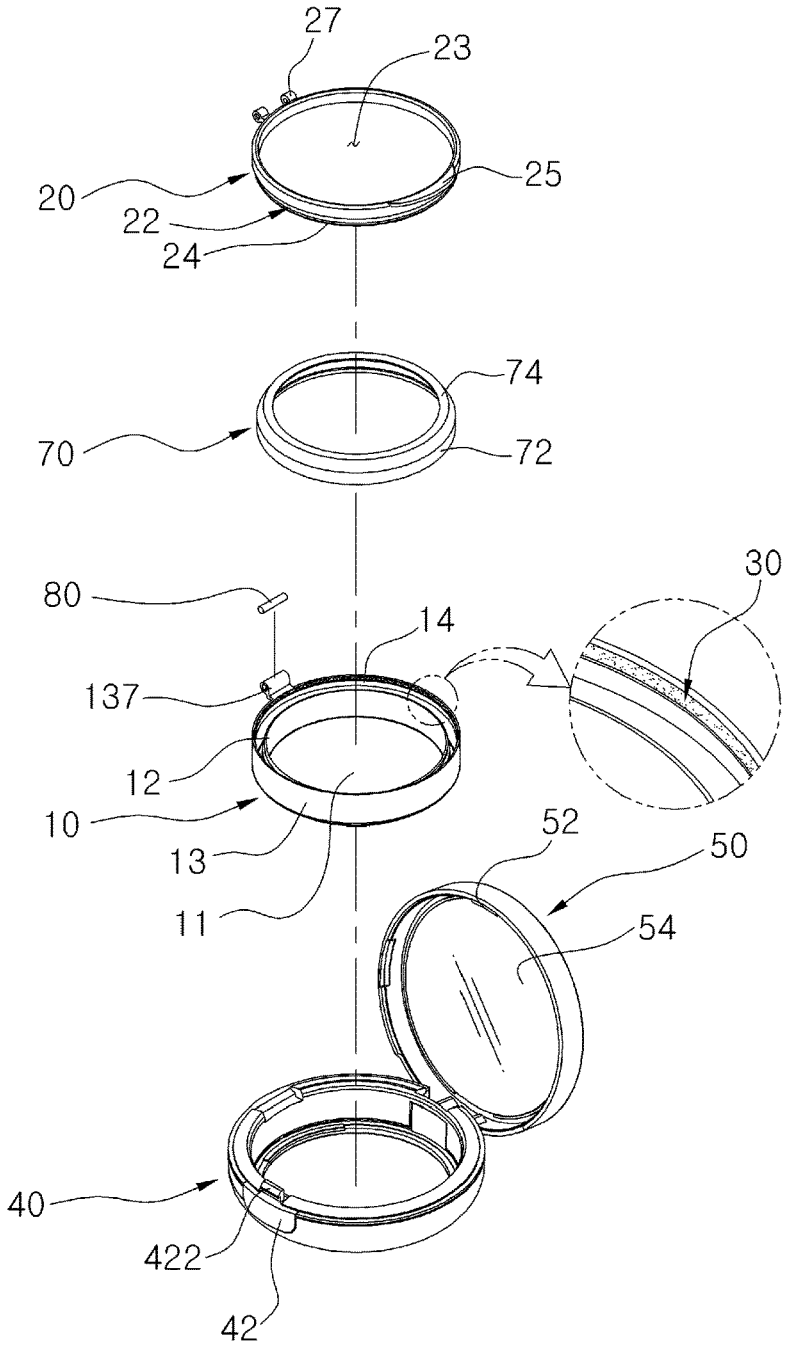
FIG. 4 is an exploded perspective view illustrating a cosmetic container according to an embodiment of the present invention.
Figure 5:
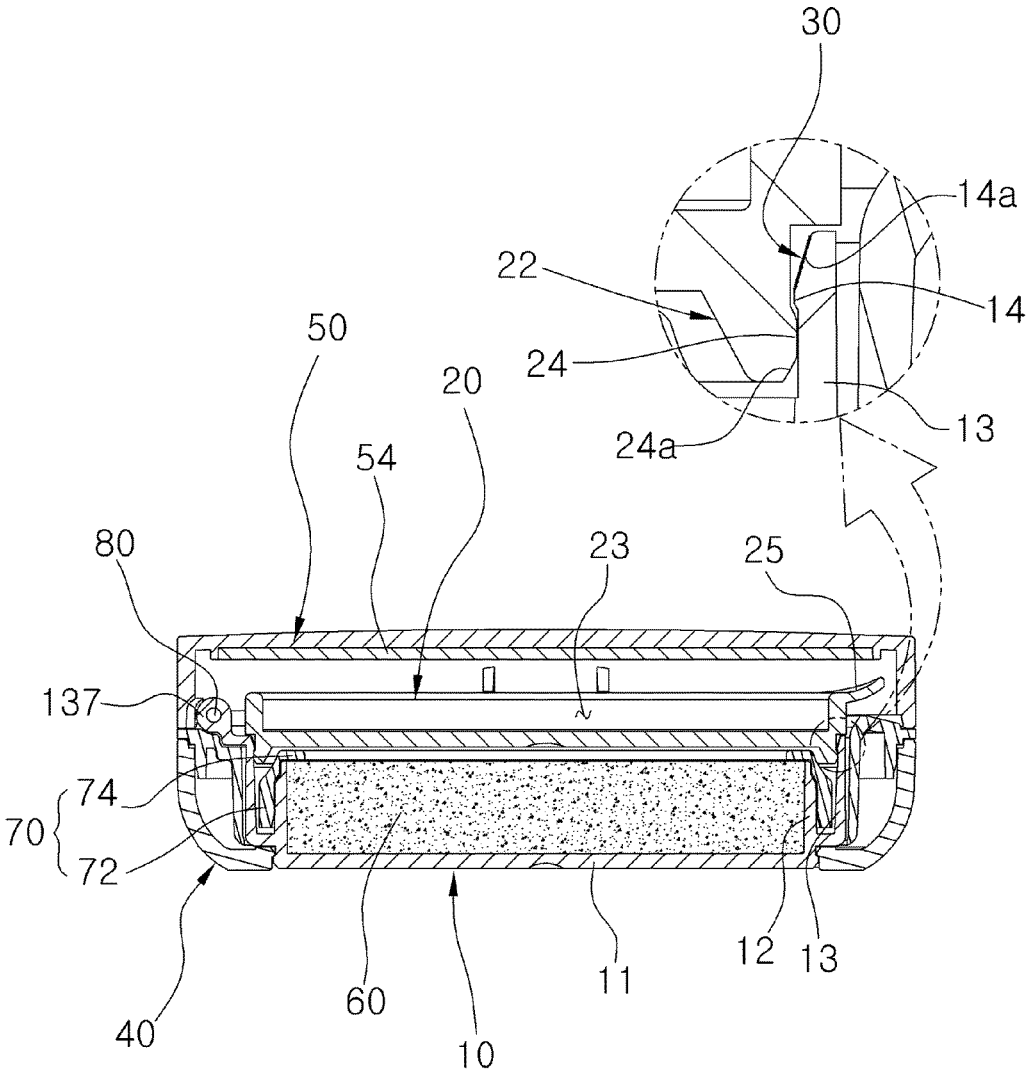
FIG. 5 is a sectional view illustrating a cosmetic container according to an embodiment of the present invention.
Figure 6:
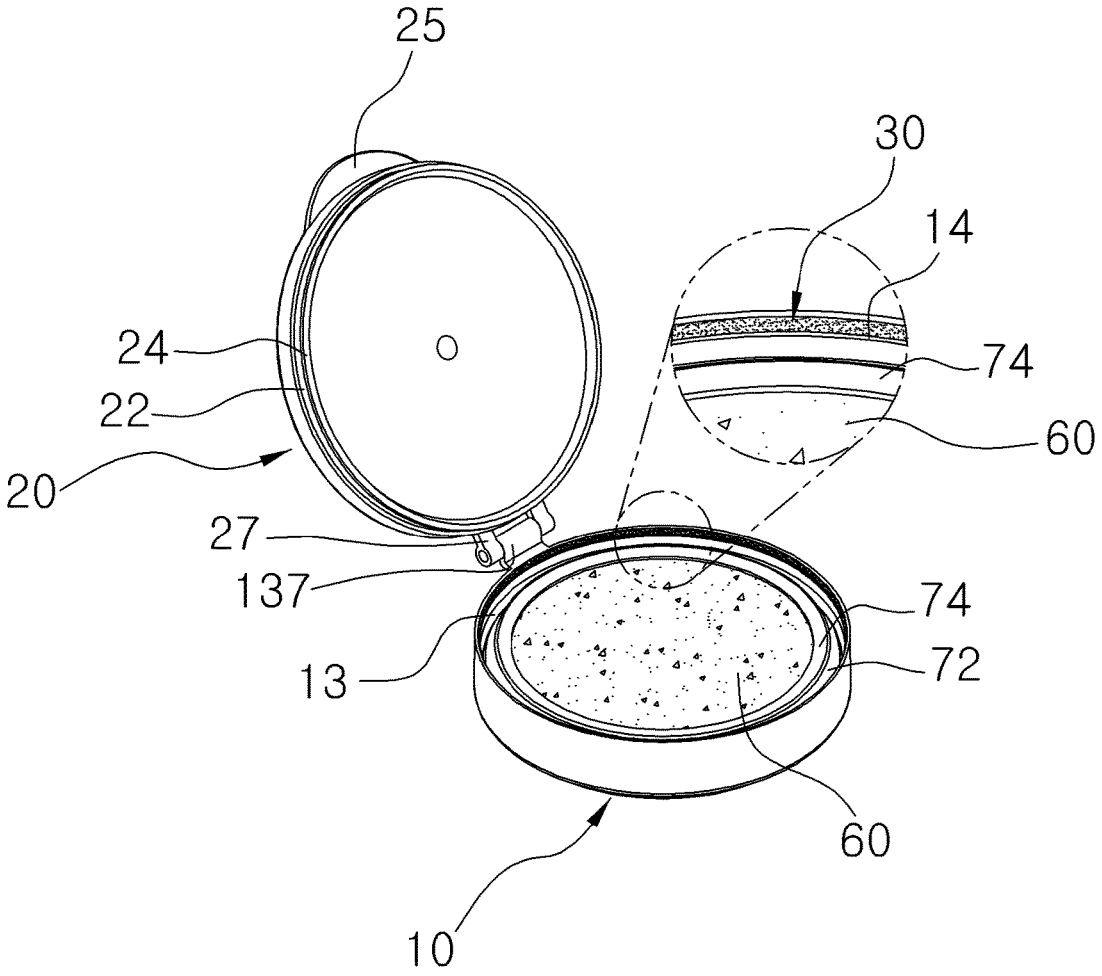
FIG. 6 is a partial perspective view illustrating a cosmetic container according to an embodiment of the present invention.
Figure 7:
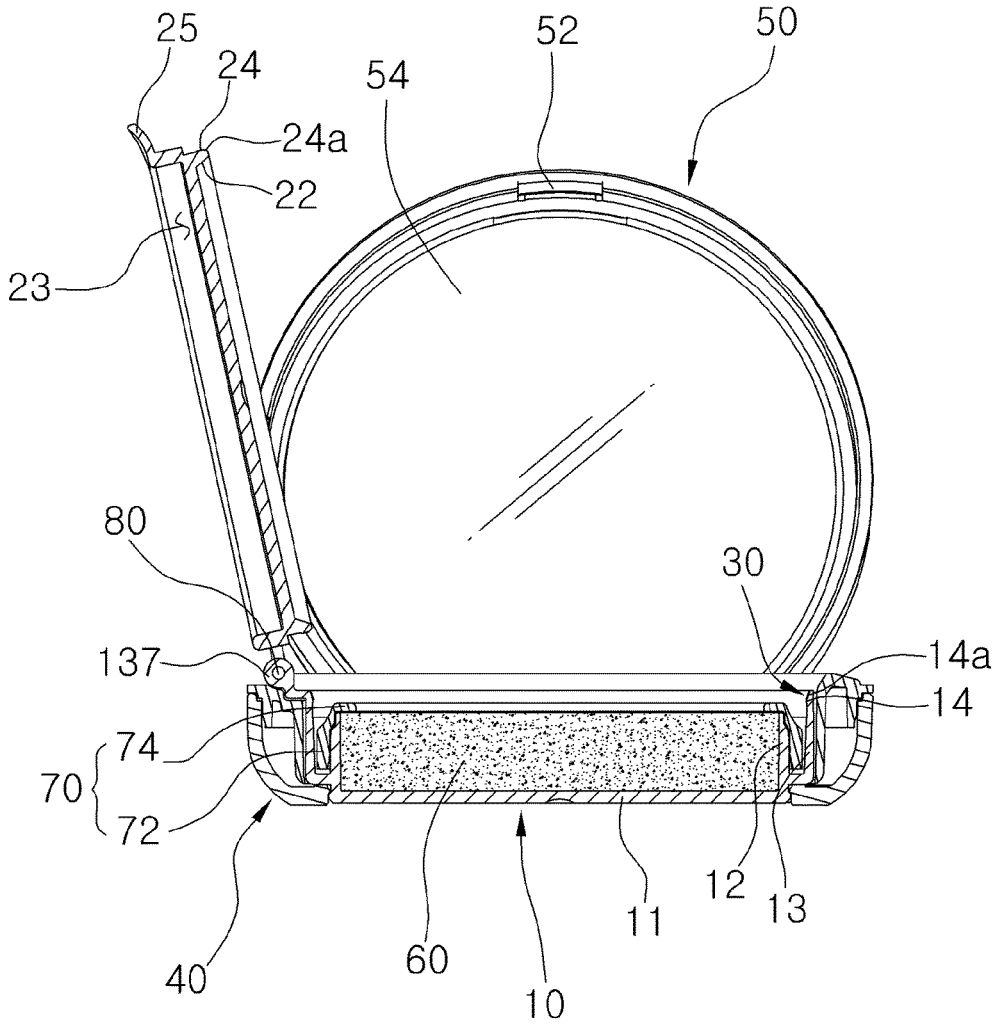
FIG. 7 is a sectional view illustrating a state that an inner container lid of a cosmetic container according to an embodiment of the present invention is opened.
Figure 8:
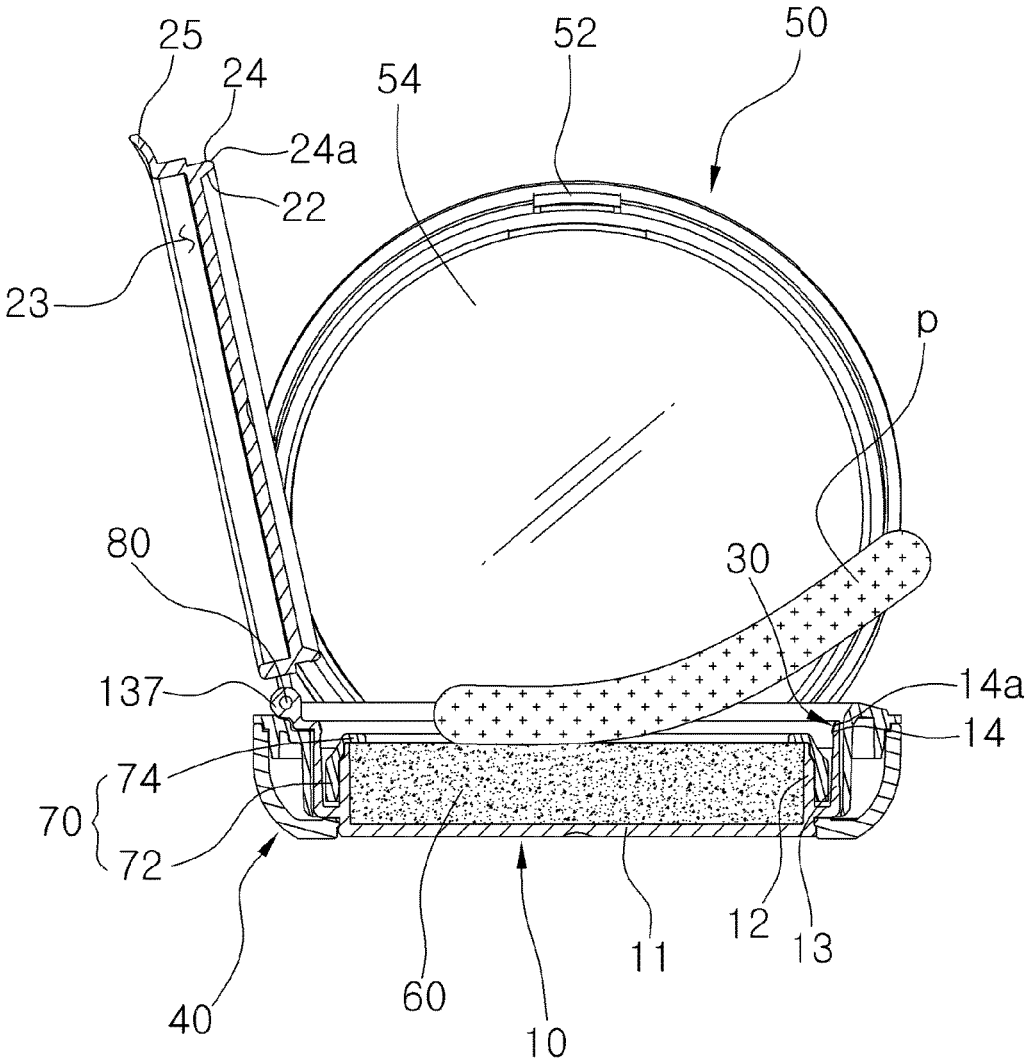
FIG. 8 is a sectional view illustrating a state that contents contained in a cosmetic container according to an embodiment of the present invention are stuck on a puff.
Figure 9:
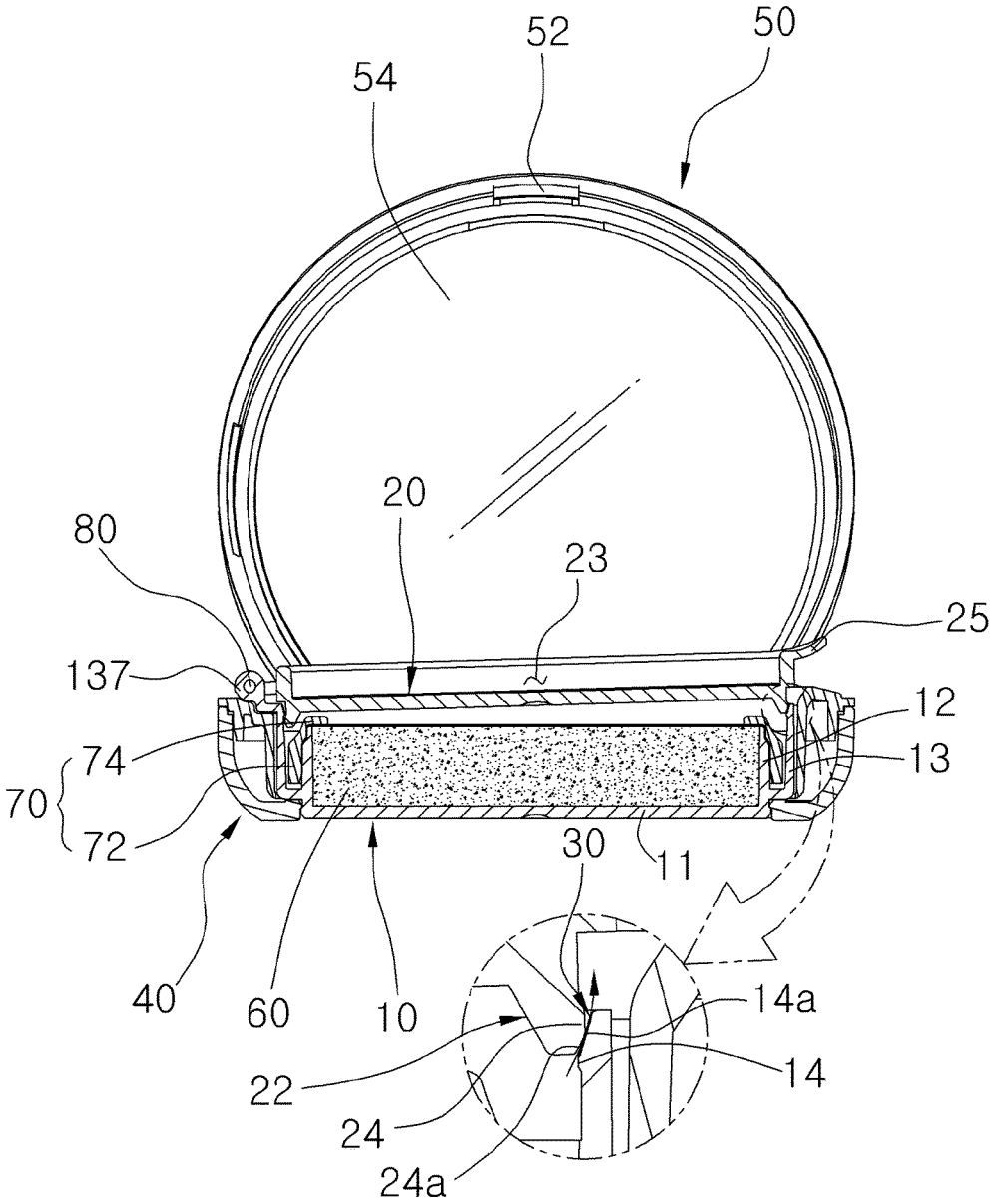
FIG. 9 is a sectional view illustrating a state that an inner container lid of a cosmetic container according to an embodiment of the present invention is closed.

FIG. 3 is a perspective view illustrating a cosmetic container according to an embodiment of the present invention. FIG. 4 is an exploded perspective view illustrating a cosmetic container according to an embodiment of the present invention. FIG. 5 is a sectional view illustrating a cosmetic container according to an embodiment of the present invention. FIG. 6 is partial perspective view illustrating a cosmetic container according to an embodiment of the present invention. FIG. 7 is a sectional view illustrating a state that an inner container lid of a cosmetic container according to an embodiment of the present invention is opened. FIG. 8 is a sectional view illustrating a state that contents contained in a cosmetic container according to an embodiment of the present invention are stuck on a puff. FIG. 9 is a sectional view illustrating a state that an inner container lid of a cosmetic container according to an embodiment of the present invention is closed.

A cosmetic container having an air circulation surface according to an embodiment of the present invention includes an inner container 10 for containing a content therein and an inner container lid 20 provided with a sealing protrusion wheel 22 for sealing the inner container 10, where a first sealing protrusion 14 is formed on the inner container 10, a second sealing protrusion 24 is formed on the sealing protrusion wheel 22 of the inner container lid 20, and the air circulation surface 30 including fine protrusions and grooves provided on the first sealing protrusion 14 of the inner container 10 or the second sealing protrusion 24 of the inner container lid 20. In addition, air compressed into the inner container 10 is discharged while being uniformly distributed onto the entire air circulation surface 30 when the inner container lid 20 is closed, and outside air is introduced into the inner container 10 through the entire air circulation surface 30 when the inner container lid 20 is opened.

A cosmetic material is charged into the inner container 10 or an impregnation member 60 into which a cosmetic material is impregnated is embedded into the inner container 10.

As shown in FIG. 4, the inner container 10 includes a bottom surface 11, an inner wall 12 upwardly extending from the bottom surface 11, and an outer wall 13 upwardly extending while being spaced apart from the inner wall 12 by a predetermined interval.

A fixing member 10 is coupled to the inner wall 12 of the inner container 10 to prevent the impregnation member 60 from being separated from the inner container 10.

The fixing member 70 includes a coupling part 72 coupled to an outer periphery of the inner wall 12, and a horizontal extension part 74 inwardly extending to prevent the separation of the impregnation member 60 embedded in the inner container 10.

A first hinge bracket 137 is formed on one side of the outer wall 13 such that the first hinge bracket 137 is hinge-coupled to a second hinge bracket 27 of the inner container lid 20 with a hinge pin 80.

As shown in FIG. 5 which is a partially enlarged view, the first sealing protrusion 14 protrudes inwardly from an inner periphery of an upper portion of the outer wall 13, and a first oblique surface inclined upwardly toward the outside of the inner container 10 is formed on the inner periphery of an upper portion of the first sealing protrusion 14.

The air circulation surface 30 is formed on a surface of an upper inner portion of the first sealing protrusion 14.

The inner container lid 20 is formed on one side of the inner container 10 to open or close the inner container 10.

A cosmetic tool keeping groove 23 capable of keeping a cosmetic tool such as a puff is formed in an upper portion of the inner container lid 20. A lid knob 25 protrudes outwardly from one side of the inner container lid 20 to enable a user to easily close or open the cosmetic container lid 20. In addition, a second hinge bracket 27 is formed at an opposite side of the lid knob 25 such that the second hinge bracket 27 is hinge-coupled to the first hinge bracket 137 of the inner container 10 with a hinge pine 80.

As shown in FIG. 5, a sealing protrusion wheel 22 having a ring shape protrudes downwardly from a lower portion of the inner container lid 20.

As shown in FIG. 5 which is a partially enlarged view, the second sealing protrusion 24 protrudes outwardly from an outer periphery of the sealing protrusion wheel 22, and a second oblique surface 24*a* inclined downwardly toward the center of the inner container lid 20 is formed on the outer periphery of a lower portion of the second sealing protrusion 24.

In the drawings of the present invention, the air circulation surface 30 formed on an inner periphery of the outer wall 13 of the inner periphery is shown. Alternatively, the air circulation surface 30 may be formed on an outer surface of a lower portion of the sealing protrusion wheel 22 of the inner container lid 20.

As shown in FIG. 4, the inner container 10 and the inner container lid 20 are coupled to an inside of a container main body 40.

A container lid 50 is hinge-coupled to one side of the container main body 40 to open or close the container main body 40.

A button 42 is formed on a front surface of the container main body 40 and a latch protrusion 422 protrudes from an upper side of the button 42.

A hook 52 having a protrusion shape is formed on a front surface of the container lid 50 and is coupled to the latch protrusion 422 of the button 42.

A mirror 54 may be provided inside the container lid 50 to enable a user to easily apply makeup.

The air circulation surface 30 is formed on the first oblique surface 14*a* of the inner container 10 or the second oblique surface 24*a* of the inner container lid 20 to allow air to be discharged or to be introduced when the inner container lid 20 is opened or closed.

The air circulation surface 30 formed on the first oblique surface 30 of the inner container 10 is shown in the drawings. Thus, the air circulation surface 30 for a cosmetic container according to the present invention will be described with reference to the drawings.

As shown in FIG. 6 which is a partially enlarged view, the air circulation surface 30 is formed on the first oblique surface 14*a* of the first sealing protrusion 14 formed on the inner periphery of the upper portion of the outer wall 13, and include fine protrusions and grooves.

That is, unlike a cosmetic container according to the related art, the cosmetic container according to the present invention is provided with the air circulation surface 30 formed on the first oblique surface 14*a* of the first sealing protrusion 14 of the inner container 10, such that air is circulated on the entire air circulation surface 30 while the inner container lid 20 makes point contact with the fine protrusions of the air circulation surface 30 when the inner container lid 20 is opened or closed. Thus, the inner container lid 20 is prevented from being lifted up by the compressed air, so that the sealing strength is improved and the opening/closing sensitivity of the inner container lid 20 is more improved.

As shown in FIG. 7, when the inner container lid 20 is opened, the second sealing protrusion 24 formed on the sealing protrusion wheel 22 of the inner container lid 20 goes over the first sealing protrusion 14 formed on the outer wall 13 of the inner container 10. In this case, the second oblique surface 24*a* of the second sealing protrusion 24 makes contact with the air circulation surface 30 formed on the first oblique surface 14*a* of the first sealing protrusion 14, so that outside air is uniformly introduced into the entire inner container 10 through the fine protrusions of the air circulation surface 30.

Similarly, as shown in FIG. 9, when the inner container lid 20 is closed, the second sealing protrusion 24 formed on the sealing protrusion wheel 22 of the inner container lid 20 goes over the first sealing protrusion 14 formed on the outer wall 13 of the inner container 10. In this case, the second oblique surface 24*a* of the second sealing protrusion 24 makes contact with the air circulation surface 30 formed on the first oblique surface 14*a* of the first sealing protrusion 14, so that the compressed air is discharged through the fine protrusions of the air circulation surface 30 while being uniformly distributed into the inside of the inner container 10.

The air circulation surface 30 is injection-molded through a mold having a molding space, a part of which is corroded by chemical, or injection-molded through a mold having a molding space, a part of which is sanded.

That is, the inner container 10 of the cosmetic container is injection-molded through the mold having a molding space, where a portion corresponding to the first oblique surface 14*a* of the inner container 10 in the molding space is treated with chemical to be corroded (the surface of the metal is oxidized or altered chemically or electrically), or sanded, such that the air circulation surface 30 including the fine protrusions and grooves is formed on the first oblique surface 14*a* of the inner container 10 while the inner container 10 is injection-molded by injecting melt resin into the molding space of the mold.

Hereinafter, a method of assembling the cosmetic container having an air circulation surface configured as described above will be described with reference to the accompanying drawings.

As shown in FIGS. 4 and 5, to assemble the cosmetic container having an air circulation surface according to an embodiment of the present invention, the impregnation member 60 impregnated with a cosmetic material is inserted to the inside of the inner container 10, or the inner container 10 is directly filled with a cosmetic material, and then, the fixing member 70 is coupled to the inner wall 12 of the inner container 10.

In this case, the first sealing protrusion 14 is formed on the inner periphery of the upper portion of the outer wall 13 of the inner container 10, and the air circulation surface 30 is formed on the entire first oblique surface 14*a* of the first sealing protrusion 14.

Describing in detail the process of forming the air circulation surface 30 in the inner container 10, by treating the portion corresponding to the first oblique surface 14*a* of the inner container 10 in the molding space with chemical to be corroded (the surface of the metal is oxidized or altered chemically or electrically), or sanding the portion, the air circulation surface 30 including the fine protrusions and grooves is formed on the first oblique surface 14*a* of the inner container 10 while the inner container 10 is injection-molded through the mold.

Next, the inner container lid 20 is hinge-coupled to one side of the inner container 10, where the first hinge bracket 137 of the inner container 10 is hinge coupled to the second hinge bracket 27 of the inner container lid 20.

Then, the inner container 10 and the inner container lid 20 coupled to each other as described above is coupled to the inside of the container main body 40 having one side to which the container lid 50 is hinge-coupled.

Last, the assembly of the cosmetic container having an air circulation surface according to an embodiment of the present invention is completed by closing the inner container lid 20 and the container lid 50.

Hereinafter, a method of using the cosmetic container having an air circulation surface assembled as described above will be described with reference to the accompanying drawings.

To use the cosmetic container having an air circulation surface according to an embodiment of the present invention, the container lid 50 is first opened from the container main body 40 and as shown in FIG. 7, the inner container lid 20 is opened from the inner container 10.

As described above, when the inner container lid 20 is opened, the second sealing protrusion 24 formed on the sealing protrusion wheel 22 of the inner container lid 20 goes over the first sealing protrusion 14 formed on the outer wall 13 of the inner container 10. In this case, the second oblique surface 24*a* of the second sealing protrusion 24 makes contact with the air circulation surface 30 formed on the first oblique surface 14*a* of the first sealing protrusion 14, so that outside air is uniformly introduced into the entire inner container 10 through the fine protrusions of the air circulation surface 30.

Thereafter, as shown in FIG. 8, a makeup is performed by applying the cosmetic material contained in the impregnation member 60 embedded in the inner container 10 or contained in the inner container 10 to a skin with a puff P.

After the makeup, as shown in FIG. 5, the inner container 10 is sealed by closing the inner container lid 20.

As described above, as shown in FIG. 9, when the inner container lid 20 is closed, the second sealing protrusion 24 formed on the sealing protrusion wheel 22 of the inner container lid 20 goes over the first sealing protrusion 14 formed on the outer wall 13 of the inner container 10. In this case, the second oblique surface 24*a* of the second sealing protrusion 24 makes contact with the air circulation surface 30 formed on the first oblique surface 14*a* of the first sealing protrusion 14, so that the compressed air is discharged through the fine protrusions of the air circulation surface 30 while being uniformly distributed into the inside of the inner container 10.

Last, the using of the cosmetic container having an air circulation surface according to an embodiment of the present invention is finished by closing the container lid 50. As described above, the cosmetic container having an air circulation surface described in this disclosure is an illustrative purpose only, and the present invention is not limited thereto. Thus, it should be understood that numerous other modifications and embodiments can be devised by those skilled in the art within the spirit and scope of the present invention and they will fall within the scope of the present invention.

What is claimed is:

1. A cosmetic container having an air circulation surface, the cosmetic container includes an inner container for containing a content therein and an inner container lid provided with a sealing protrusion wheel for sealing the inner container, the cosmetic container comprising:

a first sealing protrusion formed on the inner container;

a second sealing protrusion formed on the sealing protrusion wheel of the inner container lid; and the air circulation surface including a fine protrusion and a groove provided on the first sealing protrusion of the inner container or the second sealing protrusion of the inner container lid, wherein air compressed in the inner container is discharged while being uniformly distributed over the entire air circulation surface when the inner container lid is closed, and outside air is introduced into the inner container through the entire air circulation surface when the inner container lid is opened.

2. The cosmetic container of claim 1, wherein the inner container is formed with an inner wall and an outer wall, the first sealing protrusion is formed on an inner periphery of an upper portion of the outer wall, and the air circulation surface is formed over an entire surface of an upper inner portion of the first sealing protrusion.

3. The cosmetic container of claim 1, wherein the first sealing protrusion of the inner container is formed on an inner periphery of an upper portion thereof with a first oblique surface on which the air circulation surface is formed.

4. The cosmetic container of claim 1, wherein the second sealing protrusion of the inner container lid is formed on an inner periphery of a lower portion thereof with a second oblique surface on which the air circulation surface is formed.

5. The cosmetic container of claim 1, wherein the second sealing protrusion of the inner container lid goes over the first sealing protrusion while making point-contact with the air circulation surface formed on the inner container when the inner container lid is opened or closed.

6. The cosmetic container of claim 1, wherein the air circulation surface is injection-molded through a mold having a molding space wherein a part of the molding space is corroded by chemical, or injection-molded through a mold having a molding space wherein a part of the molding space is sanded.

* * * * *